US011843156B2

(12) United States Patent
Uemichi

(10) Patent No.: US 11,843,156 B2
(45) Date of Patent: Dec. 12, 2023

(54) MODE CONVERTER FOR CONVERTING MODES BETWEEN A POST-WALL WAVEGUIDE AND A MICROSTRIP LINE USING A BLIND VIA OF SPECIFIED SHAPE

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 253 days.

(21) Appl. No.: 17/430,765

(22) PCT Filed: Apr. 28, 2020

(86) PCT No.: PCT/JP2020/018119
§ 371 (c)(1),
(2) Date: Aug. 13, 2021

(87) PCT Pub. No.: WO2020/230625
PCT Pub. Date: Nov. 19, 2020

(65) Prior Publication Data

US 2022/0158321 A1 May 19, 2022

(30) Foreign Application Priority Data

May 10, 2019 (JP) ..... 2019-090143

(51) Int. Cl.
*H01P 5/107* (2006.01)
*H01P 3/12* (2006.01)

(52) U.S. Cl.
CPC ..... *H01P 5/107* (2013.01); *H01P 3/121* (2013.01)

(58) Field of Classification Search
CPC ..... H01P 3/121; H01P 5/103; H01P 5/107; H05K 1/116
(Continued)

(56) References Cited

U.S. PATENT DOCUMENTS

2004/0145434 A1 7/2004 Fukunaga
2007/0212934 A1 9/2007 Birgel et al.
(Continued)

FOREIGN PATENT DOCUMENTS

CN 102683785 A 9/2012
CN 103579729 A 2/2014
(Continued)

OTHER PUBLICATIONS

Notification of Transmittal of Translation of the International Preliminary Report on Patentability (Form PCT/IB/338) issued in counterpart International application No. PCT/JP2020/018119 dated Nov. 25, 2021 with Forms PCT/IB/373 and PCT/ISA/237. (5 pages).
(Continued)

*Primary Examiner* — Benny T Lee
(74) *Attorney, Agent, or Firm* — WHDA, LLP

(57) ABSTRACT

An aspect of the present invention simplifies a method of manufacturing a mode converter. A mode converter (10) includes: a post-wall waveguide (PW); a microstrip line (MS); and a blind via (BV) configured to carry out conversion between a waveguide mode of the post-wall waveguide (PW) and a waveguide mode of the microstrip line (MS), the blind via (BV) having a shape approximated by a shape obtained by combining a plurality of cylinders (C1 to C4), each of the plurality of cylinders (C1 to C4) having a diameter equal to the diameter of through vias 14*i*.

5 Claims, 8 Drawing Sheets

(58) Field of Classification Search
USPC ..... 333/26, 248
See application file for complete search history.

(56) References Cited

U.S. PATENT DOCUMENTS

| | | | | |
|---|---|---|---|---|
| 2015/0349398 | A1 | 12/2015 | Uemichi | |
| 2016/0372373 | A1* | 12/2016 | Asahi | H01P 5/107 |

FOREIGN PATENT DOCUMENTS

| | | | |
|---|---|---|---|
| CN | 109661749 | A | 4/2019 |
| JP | 10-75022 | A | 3/1998 |
| JP | 2004-200783 | A | 7/2004 |
| JP | 2014-158243 | A | 8/2014 |
| JP | 2014236291 | A | 12/2014 |
| JP | 2018023030 | A | 2/2018 |

OTHER PUBLICATIONS

International Search Report dated Jul. 21, 2020, issued in counterpart application No. PCT/JP2020/018119, w/English translation (5 pages).
Written Opinion dated Jul. 21, 2020, issued in counterpart application No. PCT/JP2020/018119 (3 pages).
Uemichi et al. "A Ultra Low-Loss Silica-Based Transformer between Microstrip Line and Post-Wall Waveguide for Millimeter-Wave Antenna-In-Package Applications," IEEE MTT-S IMS, Jun. 2014, cited in Specification (3 pages).

* cited by examiner

MODE CONVERTER FOR CONVERTING MODES BETWEEN A POST-WALL WAVEGUIDE AND A MICROSTRIP LINE USING A BLIND VIA OF SPECIFIED SHAPE

TECHNICAL FIELD

The present invention relates to a mode converter which carries out mutual conversion between a waveguide mode of a post-wall waveguide and a waveguide mode of a microstrip line, and a method of manufacturing the mode converter.

BACKGROUND ART

Non-Patent Literature 1 discloses mode converters each of which carries out mutual conversion between a waveguide mode of a post-wall waveguide and a waveguide mode of a microstrip line.

In such mode converters, the post-wall waveguide includes a dielectric (e.g., quartz) substrate, a pair of conductor layers formed on a pair of main surfaces of the substrate, respectively, and a post wall formed inside the substrate. The pair of conductor layers functions as a pair of wide walls which sandwich a waveguide region from two directions (e.g., upper and lower directions). The post wall functions as a pair of narrow walls and a pair of short walls which surround the waveguide region from four directions (e.g., front, rear, left, and right directions). The post wall is constituted by a plurality of through vias which are provided in a palisade arrangement inside the substrate, and which short-circuit the pair of conductor layers to each other. The palisade arrangement means that the through vias are arranged so as to surround a planar area inside the substrate.

In order to carry out mutual conversion between the waveguide mode of the post-wall waveguide and the waveguide mode of the microstrip line, the above-described mode converter includes a blind via which is connected to one end of a signal line included in the microstrip line, and which is formed in the post-wall waveguide.

The through vias described above is formed by (i) forming through-holes in the substrate and then (ii) covering respective side surfaces of the through-holes with a conductor layer. Similarly, the blind via described above is formed by (i) forming a non-through-hole in the substrate and then covering a bottom surface and a side surface of the non-through-hole with a conductor layer. In order to form the through-holes and the non-through-hole in the substrate here, it is possible to suitably use, for example, a combination of a laser beam machine and etching by a wet process, or a drill.

CITATION LIST

Non-Patent Literature

[Non-patent Literature 1]
Yusuke Uemichi, et al. "A ultra low-loss silica-based transformer between microstrip line and post-wall waveguide for millimeter-wave antenna-in-package applications," IEEE MTT-S IMS, June 2014.

SUMMARY OF THE INVENTION

Technical Problem

In such a mode converter disclosed in Non-Patent Document 1, in a case where the substrate has a constant thickness, the post-wall waveguide has a central frequency which depends on the width of the post-wall waveguide (that is, a distance between the pair of narrow walls). Therefore, in designing mode converters of a plurality of aspects having different desired central frequencies, respectively, the width of the post-wall waveguide corresponding to a desired central frequency is first determined. Then, other design parameters, such as the length of the blind via, are determined. In other words, in a mode convertor having a lower desired central frequency, the width of the post-wall waveguide becomes larger. On the other hand, in a mode converter having a higher desired central frequency, the width of the post-wall waveguide becomes smaller.

In addition, the inventor of the present application has found that in order to obtain a desired characteristic, it is preferable to determine the diameter DB of the above-described blind via in accordance with the width of the post-wall waveguide. Specifically, it is preferable to have a larger diameter DB for a wider post-wall waveguide, and to have a smaller diameter DB for a narrower post-wall waveguide. Note that it is an example of the desired characteristic that an S-parameter S(1, 1) is less than −20 dB in an operation band.

For example, in the case of a post-wall waveguide having, as an operation band thereof, the 60 GHz band (e.g., not less than 57 GHz and not more than 66 GHz), the thickness of the substrate made of quartz is, for example, 500 μm and the width of the post-wall waveguide is, for example, 2.0 mm. In this case, an example of a preferable diameter DB for obtaining a desired characteristic is 100 μm.

Further, for example, in the case of a post-wall waveguide having, as the operation band thereof, the 28 GHz band (e.g., not less than 27.0 GHz and not more than 29.5 GHz), the thickness of the substrate made of quartz is, for example, 700 μm and the width of the post-wall waveguide is, for example, 4 mm. In this case, if a diameter DB of 100 μm is employed as in the post-wall waveguide having the 60 GHz band as the operation band, the desired characteristic cannot be obtained as shown in FIG. 9. FIG. 9 is a graph showing the frequency dependence (in GHz) of the S-parameter S(1, 1) in dB of mode converters included in a comparative example group of the present invention. Therefore, in the post-wall waveguide having the 28 GHz band as the operation band, the diameter DB larger than 100 μm is employed.

Further, the diameter DT of the through vias included in the mode converter has a preferred value regardless of the diameter DB. This preferred diameter DT depends on complexity of the shape of the post-wall waveguide when seen in plan view. The more complex the shape of the post-wall waveguide is, the smaller the diameter DT becomes. This is because in a case where a large diameter DT is employed, it is difficult to produce a post-wall waveguide having a complex shape. In view of production of a post-wall waveguide having a complex shape, the preferred diameter DT is approximately 100 μm.

As described above, on the assumption that a post-wall waveguide is to be designed, it is preferable to treat the diameter DB and the diameter DT as separate independent design parameters. Meanwhile, on the assumption that mode converters of a plurality of aspects having different desired central frequencies, respectively, are to be produced, it is preferable that the diameter DB be the same as the diameter DT of the through vias included in the mode converter. If the diameters DT and DB differ from each other, the step of forming the through vias in the substrate needs to be separated from the step of forming the blind via in the substrate. This increases the number of steps in a method of manufacturing a mode converter.

An aspect of the present invention is attained in view of the above problem. An object of an aspect of the present invention is to simplify a method of manufacturing a mode converter which carries out mutual conversion between a waveguide mode of a post-wall waveguide and a waveguide mode of a microstrip line.

Solution to the Problem

In order to solve the above problem, a mode converter in accordance with Aspect 1 of the present invention includes: a post-wall waveguide; a microstrip line formed on a main surface of the post-wall waveguide; and a blind via formed in the post-wall waveguide, the blind via being configured to carry out mutual conversion between a waveguide mode of the post-wall waveguide and a waveguide mode of the microstrip line, the blind via having a shape approximated by a shape obtained by combining a plurality of cylinders having central axes orthogonal to the main surface, respectively, and each of the plurality of cylinders having a diameter equal to a diameter of a cylinder by which a shape of each of through vias constituting a post wall of the post-wall waveguide is approximated.

Advantageous Effects of the Invention

An aspect of the present invention makes it possible to simplify a method of manufacturing a mode converter which carries out mutual conversion between a waveguide mode of a post-wall waveguide and a waveguide mode of a microstrip line.

BRIEF DESCRIPTION OF THE DRAWINGS (a) of FIG. 1 is a plan view of a mode converter in accordance with Embodiment 1 of the present invention. (b) of FIG. 1 is an enlarged cross-sectional view of the mode converter illustrated in (a) of FIG. 1.

(a) of FIG. 2 shows a plan view and a side view of a blind via provided in the mode converter illustrated in (a) of FIG. 1. (b) of FIG. 2 shows a plan view and a side view which illustrate Variation 1 of the blind via illustrated in (a) of FIG. 2.

(a) of FIG. 3 shows a plan view and a cross sectional view which illustrate Variation 2 of the blind via illustrated in (a) of FIG. 2, and (b) of FIG. 3 shows a plan view and a cross sectional view which illustrate Variation 3 of the blind via illustrated in (a) of FIG. 2.

Throughout the detail description of the drawings, like features appearing in the different drawings are denoted by the same reference labels.

DETAILED DESCRIPTION OF THE EMBODIMENTS

Embodiment 1

Figure 1:
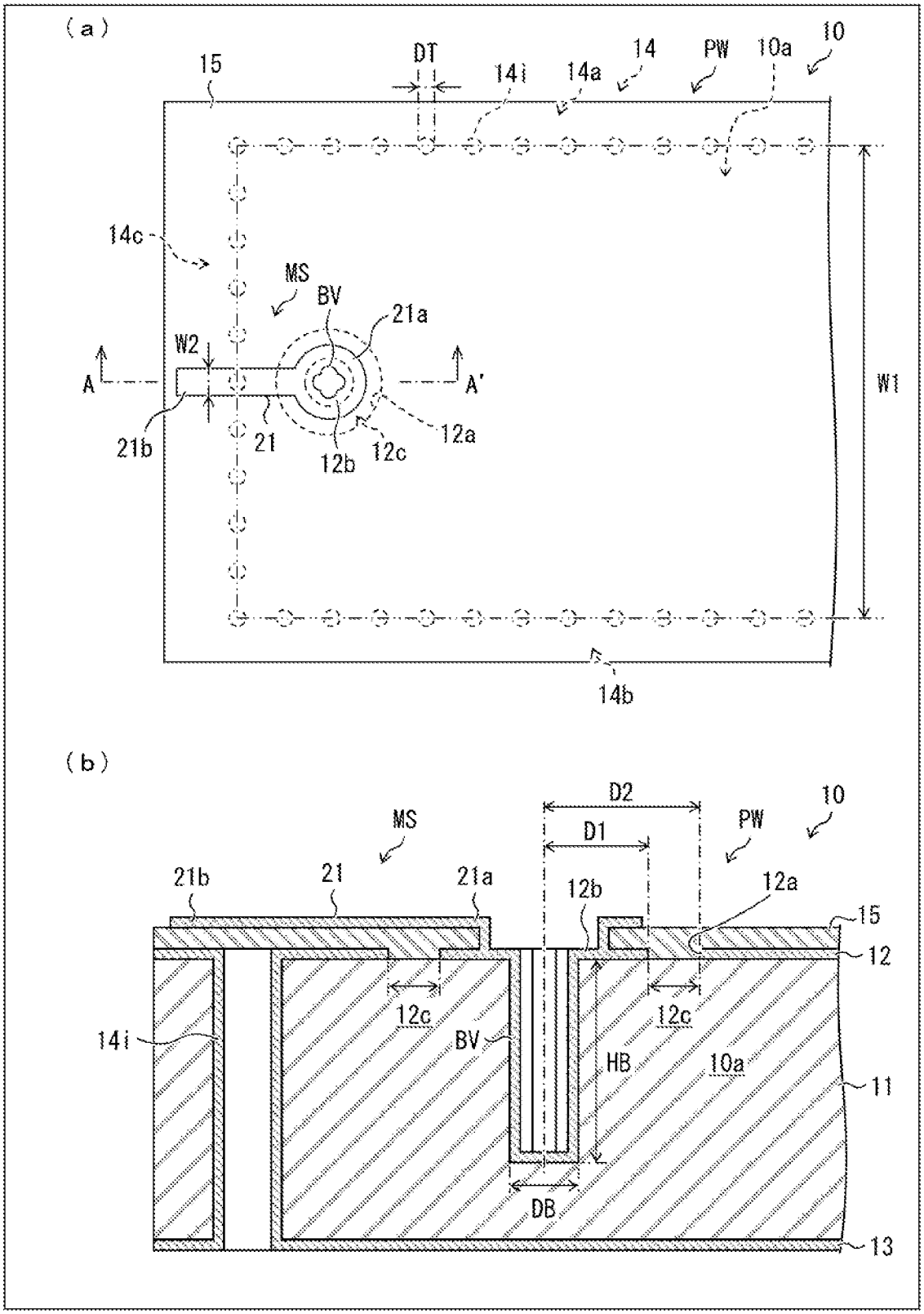
Figure 2:
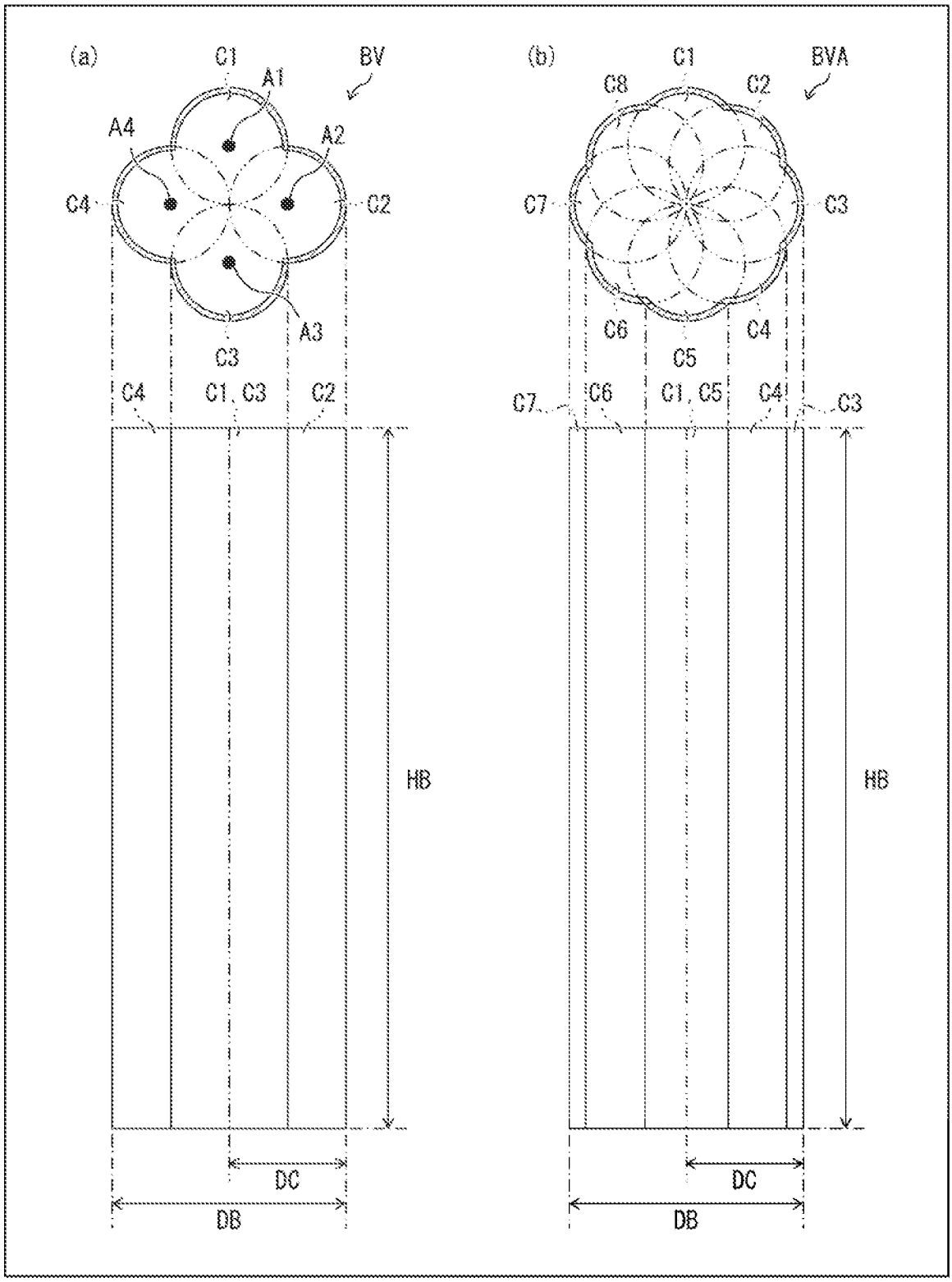
Figure 3:
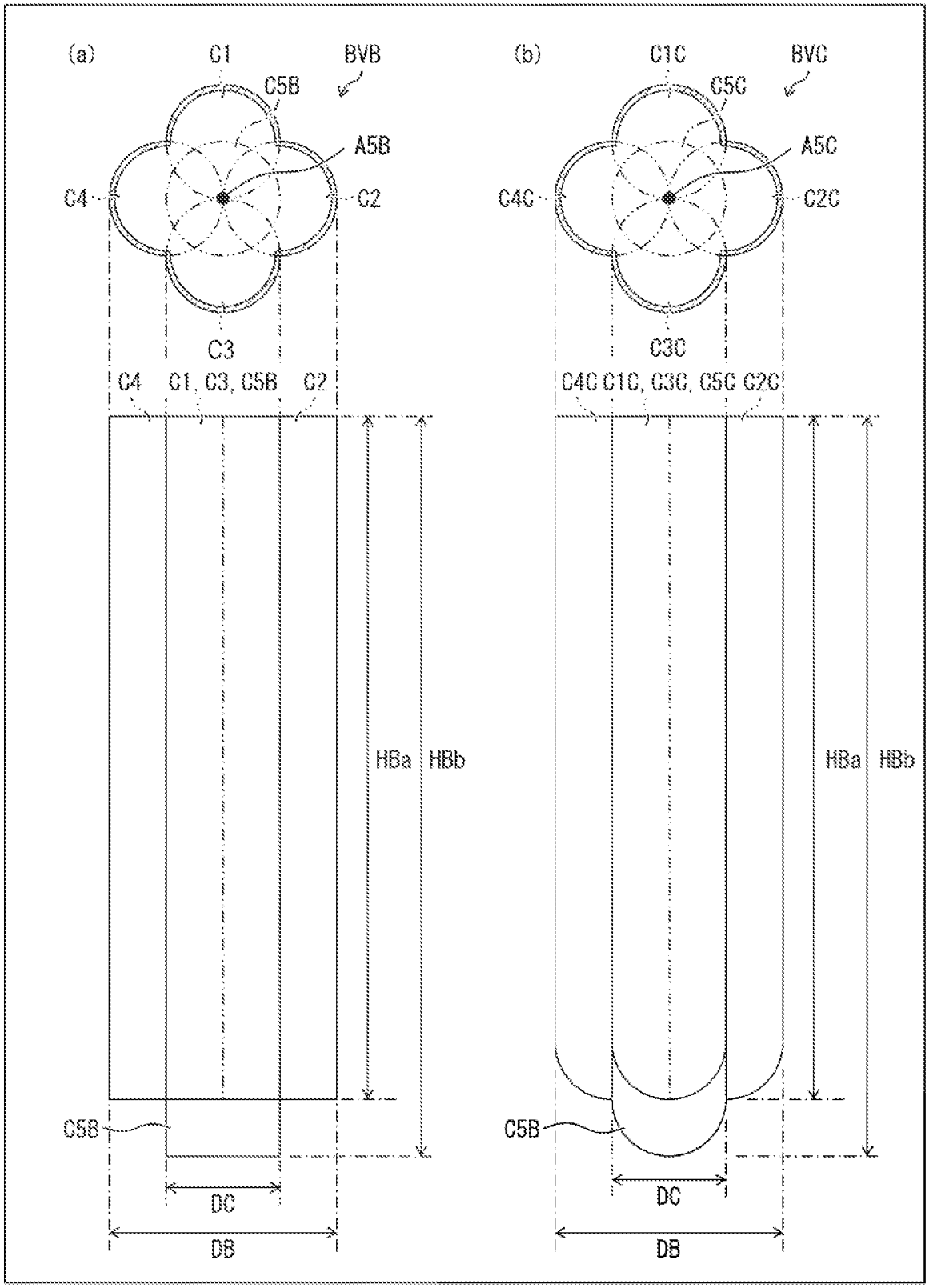

The following will discuss a mode converter in accordance with Embodiment 1 of the present invention, with reference to FIGS. 1 to 3. (a) of FIG. 1 is a plan view of a mode converter 10 in accordance with Embodiment 1 of the present invention. (b) of FIG. 1 is an enlarged cross-sectional view of the vicinity of a blind via BV provided in the mode converter 10. (a) of FIG. 2 shows a plan view and a side view of the blind via BV. (b) of FIG. 2 shows a plan view and a side view of a blind via BVA which is Variation 1 of the blind via BV. (a) of FIG. 3 shows a plan view and a side view of a blind via BVB which is Variation 2 of the blind via BV. (b) of FIG. 3 shows a plan view and a side view of a blind via BVC which is Variation 3 of the blind via BV.

<Configuration of Mode Converter 10>

As illustrated in (a) and (b) of FIG. 1, the mode converter 10 includes a post-wall waveguide PW, a microstrip line MS, and a blind via BV.

(Post-Wall Waveguide PW)

As illustrated in (b) of FIG. 1, the post-wall waveguide PW includes a substrate 11, conductor layers 12 and 13, a post wall 14, and a dielectric layer 15.

The substrate 11 is a plate-like member made of a dielectric. In the present embodiment, the substrate 11 is made of quartz. The dielectric constituting the substrate 11 is not limited to quartz. The dielectric can be appropriately selected in accordance with, for example, the central frequency of the mode converter 10.

The conductor layer 12 and the conductor layer 13 are layer members formed respectively on a pair of main surfaces which the substrate 11 has and which face each other. The conductor layers 12 and 13 are each a layer member made of a conductor, and are made of copper in Embodiment 1. The conductor constituting the conductor layers 12 and 13 are not limited to copper, and can be appropriately selected. The thicknesses of the conductor layers 12 and 13 can also be appropriately selected. The conductor layers 12 and 13 each can be a relatively thin layer member called a "conductor film", or can be a relatively thick layer member called a "conductor plate".

The post wall 14 is made of a plurality of through vias 14*i* to Hn provided in a palisade arrangement inside substrate 11. The palisade arrangement means that the through vias 141 to 14*n* are arranged so as to surround a planar area inside the substrate 11. The number of the plurality of through vias 14*i* is "n," that is, the plurality of through vias 14*i* includes 141 to 14*n*. Here, n is any integer of not less than 2. Hereinafter, the through vias 141 to 14*n* are each generically referred to as a through via 14*i*. Here, i is an integer of not less than 1 and not more than n. The post wall 14 includes a pair of narrow walls 14*a* and 14*b* which face each other, and a short wall 14*c* and another short wall (not illustrated in (a) and (b) of FIG. 1) facing the short wall 14*c*. The through via 14*i* is made of a conductor having a hollow cylinder shape or a solid cylinder shape (hollow cylinder shape in the present embodiment). Regardless of whether the vicinity of the central axis of the through via 14*i* is hollow or solid, the through via 14*i* has an outer edge shape which can be approximated by a cylinder.

The through via 14*i* extends from one main surface of the substrate 11 to the other main surface of the substrate 11, and short-circuits the conductor layer 12 and the conductor layer 13 to each other. Further, the diameter DT of the through via 14*i* can be appropriately determined in accordance with, for example, the width W1 of the post-wall waveguide PW and/or complexity of the shape of the post-wall waveguide PW. In Embodiment 1, the diameter DT is set to 100 μm. It should be noted that the diameter DT is also a diameter of the cylinder by which the outer edge shape of the through via 14*i* is approximated.

In the mode converter 10, the conductor layers 12 and 13 sandwich the substrate 11 from two directions (e.g., upper and lower directions). Moreover, the narrow walls 14*a* and 14*b* sandwich a partial region of the substrate 11 from two directions (e.g., left and right directions). Further, the short wall 14*c* and the another short wall sandwich the partial region of the substrate 11 from the other two directions (e.g., front and rear directions). The partial region of the substrate 11 are surrounded, by the conductor layers 12 and 13, the narrow walls 14*a* and 14*b*, the short wall 14*c*, and the another short wall, from the above six directions. This partial region functions as a waveguide region 10*a* of the mode converter 10. The waveguide region 10*a* is illustrated as a region surrounded by three sides indicated with a two-dot chain line, in (a) of FIG. 1. Meanwhile, the waveguide region 10*a* is a region on the right of the through via 14*i* in (b) of FIG. 1, and is also a region sandwiched between the conductor layers 12 and 13. It should be noted that the two-dot chain line shown in (a) of FIG. 1 is a straight line passing through respective centers of through vias 14*i*. The distance between the narrow wall 14*a* and the narrow wall 14*b* is hereinafter referred to as the width W1 of the post-wall waveguide PW.

The dielectric layer 15 is a layer member formed on the conductor layer 12 so as to cover the conductor layer 12. The dielectric layer 15 is a layer member made of a dielectric, and is made of a polyimide resin in Embodiment 1. The dielectric constituting the dielectric layer 15 is not limited to a polyimide resin, and can be appropriately selected.

(Microstrip Line MS)

As illustrated in (a) and (b) of FIG. 1, the microstrip line MS includes the conductor layer 12, the dielectric layer 15, and a signal line 21 which is formed on the dielectric layer 15.

The signal line 21 is a strip-shaped conductor pattern having one end formed in a circular shape. This one end is referred to as an end portion 21*a*. Except for the end portion 21*a*, the signal line 21 has a constant width W2. The diameter of the end portion 21*a* is configured to be larger than the width W2.

The signal line 21 has the end portion 21*a* including the blind via BV (described later), and another end portion 21*b* which is the other end of the signal line 21 and which is provided outside the waveguide region 10*a*, when the post-wall waveguide PW is seen in plan view.

(Blind via BV)

As illustrated in (a) and (b) of FIG. 1, the blind via BV is made of a conductor which has a tubular shape or a pillar shape (tubular shape in Embodiment 1) and which is formed inside the substrate 11 of the post-wall waveguide PW. The blind via BV is obtained by (i) forming, at a predetermined position in the waveguide region 10*a*, a non-through-hole which reaches inside the substrate 11 from one main surface (main surface on a side where the conductor layer 12 is present) of the substrate 11 and (ii) forming a conductor film on a side surface of the non-through-hole (or filling the non-through-hole with a conductor). Therefore, the blind via BV has a bottom end (end surface on a side where the conductor layer 13 is present) which is located inside the substrate 11 and apart from the conductor layer 13.

The conductor layer 12 has a portion removed. This portion is a circular ring-like portion which surrounds the blind via BV when the post-wall waveguide PW is seen in plan view. Consequently, when seen in plan view, (1) the conductor layer 12 is provided with an anti-pad 12*c* which is formed as an opening that surrounds the blind via BV, and (2) the conductor layer 12 has a conductor pattern 12*b* which is a portion of the conductor layer 12 on an inner side of the anti-pad 12*c*. Accordingly, the diameter D2 of an opening 12*a* is larger than the diameter D1 of the conductor pattern 12*b*.

When seen in plan view, the dielectric layer 15 has an opening formed in a region including the blind via BV, and the end portion 21*a* of the above-described signal line 21 is formed so as to include the blind via BV and the opening. The blind via BV is short-circuited to the signal line 21 via the conductor pattern 12*b* and via a conductor layer formed on a side wall of the opening of the dielectric layer 15.

The blind via BV configured as above carries out mutual conversion between a waveguide mode of the post-wall waveguide PW and a waveguide mode of the microstrip line MS.

The blind via BV has a shape that is approximated by a shape obtained by combining cylinders C1, C2, C3, and C4 (see (a) of FIG. 2). In other words, assuming that each of the cylinders C1 to C4 is a set of points, the shape of the blind via BV is approximated by a union of the cylinders C1 to C4.

It should be noted that the cylinders Cl to C4 have central axes A1, A2, A3, and A4 orthogonal to the conductor layer 12, respectively. All of the cylinders C1 to C4 have the same diameter DC and the same height HB. That is, the cylinders C1 to C4 are congruent to each other. Consequently, when the post-wall waveguide PW is viewed in plan view, the contour of the blind via BV can be approximated by a circle. In the following description, the diameter DB of this approximate circle is assumed to be the diameter of the blind via BV.

In the mode converter 10, the diameter DC of each of the cylinders C1 to C4 is identical to the diameter DT described above. In Embodiment 1, DC=DT=100 μm.

Also, in the mode converter 10, the above-described combined cylinders C1 to C4 possess four-fold rotational symmetry with respect to a symmetrical axis which is located at the intersection of respective sides of the cylinders C1 to C4 and which is parallel to the central axes A1 to A4.

It should be noted that the shape of the blind via BV is considered to vary within a predetermined range due to a manufacturing tolerance etc. The shape of the blind via BV only needs to be the shape approximated by the shape obtained by combining the cylinders C1 to C4. In other words, the blind via BV may or may not coincide with the shape of the combined cylinders C1 to C4.

(Variation 1)

In a blind via BVA which is Variation 1 of the blind via BV, the number N of the cylinders C1 to CN (N is an integer of 2 or more), by which the shape of the blind via BV is approximated, is not limited to 4. The number N can be determined as appropriate. As the number N of the cylinders increases, the shape of the blind via BV can be closer to a cylinder. (b) of FIG. 2 illustrates the blind via BVA in which N=8, as an example of a case where the number N of cylinders is not 4.

The blind via BVA has a shape approximated by a shape obtained by combining cylinders Cl, C2, C3, C4, C5, C6, C7, and C8. The blind via BVA also has eight-fold rotational symmetry in plan view.

(Variation 2)

A blind via BVB, which is Variation 2 of the blind via BV, has a shape approximated by a shape obtained by combining the cylinders C1 to C4 described above and an additional cylinder C5B (see (a) of FIG. 3).

That is, the blind via BVB has a shape approximated by a shape obtained by combining those five cylinders C1 to C4 and C5B. The cylinders C1 to C4 are arranged so as to surround the cylinder C5B.

Here, the height HBa of each of the cylinders C1 to C4 is the same as the height HB of each of the cylinders C1 to C4 illustrated in (a) of FIG. 2. Meanwhile, the height HBb of the cylinder C5B is larger than the height HBa. That is, in the blind via BVB, the cylinder C5B has a bottom surface (end surface on a side where the conductor layer 13 is present) which protrudes from respective bottom surfaces of the cylinders C1 to C4 (end surfaces on the side where the conductor layer 13 is present).

The above-described combined cylinders C1 to C4 and C5B have four-fold rotational symmetry with respect to the central axis A5B of the cylinder C5B as the axis of symmetry.

(Variation 3)

A blind via BVC, which is Variation 3 of the blind via BV, is also a variation of the blind via BVB illustrated in (a) of FIG. 3. The blind via BVC is obtained by changing, to a shape approximated by part of a spherical surface, respective shapes of the bottom surfaces of the cylinders C1 to C4 and C5B, by which the shape of the blind via BVB is approximated (see (b) of FIG. 3).

In other words, the blind via BVC has a shape approximated by a shape obtained by combining five cylinders C1C, C2C, C3C, C4C, and C5C. That is, the cylinders C1C to C4C are arranged so as to surround the cylinder C5C. In addition, the bottom surface of each of the cylinders C1C to C5C is approximated by part of a spherical surface.

Further, as in the case of the blind via BVB, the height HBa of each of the cylinders C1C to C4C is the same as the height HB of each of the cylinders C1 to C4 illustrated in (a) of FIG. 2, and the height HBb of the cylinder C5C is larger than the height HBa.

The combined cylinders C1C to C5C have four-fold rotational symmetry with respect to the central axis A5C of the cylinder C5C as the axis of symmetry.

Embodiment 2

Figure 4:
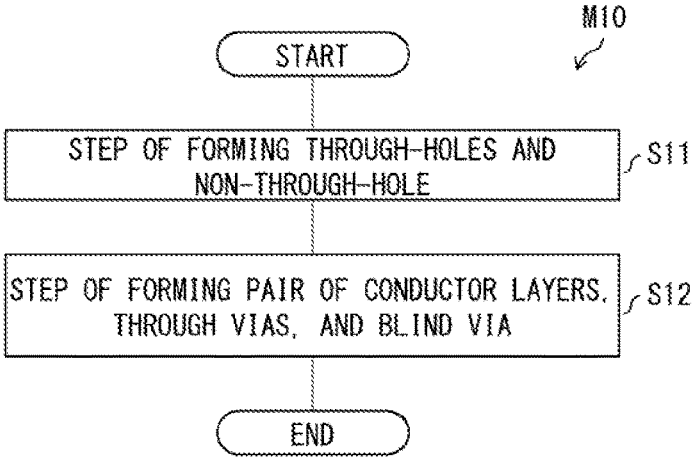
FIG. 4 is a flowchart of a method of manufacturing the mode converter illustrated in FIG. 1.

The following will discuss a manufacturing method M10 in accordance with Embodiment 2 of the present invention, with reference to FIG. 4. This manufacturing method M10 is a method of manufacturing the above-described mode converter 10. In Embodiment 2, although the manufacturing method M10 will be described by using a blind via BV as an example, blind vias BVA, BVB, and BVC each can be similarly manufactured. Note that for convenience of explanation, the description about the blind via BV will not be repeated here.

As illustrated in FIG. 4, the manufacturing method M10 starts at "START" and ends at "END," and the manufacturing method M10 includes a step S11 of forming a plurality of through-holes and a non-through-hole, and a step S12 of forming conductor layers 12 and 13, through vias 14*i*, and the blind via BV. The step S11 is an example of a first step described in Claims and the step S12 is an example of a second step described in Claims. In Embodiment 2, the following description assumes that the conductor layers 12 and 13, the through vias 14*i*, and the blind via BV are formed in the step S12. However, the conductor layers 12 and 13 may be formed in another step that is separate from the step S12 of forming the through vias 14*i* and the blind via BV.

The step S11 is the step of forming a plurality of through-holes corresponding to the respective through vias 14*i* and a non-through-hole corresponding to the blind via BV in the substrate 11. More specifically, in the step S11, (1) a plurality of through-holes, each through-hole having a cylindrical shape, are formed at respective positions corresponding to the through vias 14*i* illustrated in FIG. 1, by repeating the operation of forming a through-hole which penetrates through the substrate 11 of the post-wall waveguide PW, and (2) a non-through-hole, which has a shape approximated by a shape obtained by combining the cylinders C1 to C4, is formed at a position corresponding to the blind via BV illustrated in FIG. 1, by repeating the operation of forming a cylindrical non-through hole (that is, a non-through-hole having the shape of each of the cylinders Cl to C4 illustrated in (a) of FIG. 2) from one main surface side of the substrate 11 toward an interior of the substrate 11 of the post-wall waveguide PW. It should be noted that as described above, the cylinders C1 to C4 have central axes A1 to A4 orthogonal to the conductor layer 12, respectively. In the step S11, the plurality of through-holes corresponding to the through vias 14*i*, respectively, and a plurality of the cylindrical non-through-holes corresponding to the blind via BV are formed so that respective diameters of the through-holes and the non-through-hole become the same.

These through-holes and the cylindrical non-through-holes can also be formed by a combination of a laser beam machine and etching by a wet process, or a drill. In Embodiment 2, the step S11 is carried out by using the laser beam machine. More specifically, the plurality of through-holes and the cylindrical non-through-holes are formed by: (1) carrying out a modification treatment on quartz constituting the substrate 11, by irradiating predetermined positions of the substrate 11 with laser light which is generated by the laser beam machine; and (2) etching modified regions of the substrate 11 (i.e., regions corresponding to the plurality of through-holes and the cylindrical non-through-holes) by immersing, in a hydrofluoric acid solution, the substrate 11 which has undergone the modification treatment.

In the step S12, the through vias 14*i* and the blind via BV are formed by covering, with a conductor layer, side surfaces of the plurality of through-holes formed in the step S11 and a bottom surface and a side surface of the non-through-hole formed in the step S11. In Embodiment 2, in the step S12, the conductor layers 12 and 13 are also formed in addition to the through vias 14*i* and the blind via BV. More specifically, (1) a copper thin film, which is to be the conductor layer 12, is formed on one main surface of the substrate 11 where the plurality of through-holes and the non-through-hole are formed in the step S11. Then, (2) another copper thin film, which is to be the conductor layer 13, is formed on the other main surface of the substrate 11 where the conductor layer 12 is formed. In the step of forming the conductor layer 12, most part of each of the through vias 14*i* and the blind via BV are formed. Further, in the step of forming the conductor layer 13, each of the through vias 14*i* is completely formed. It should be noted that either one of the step of forming the conductor layer 12 and the step of forming the conductor layer 13 may be carried out first.

It should be noted that in the step S12, the through vias 14*i* and the blind via BV are not necessarily formed by covering, with a conductor layer, the side surfaces of the plurality of through-holes formed in the step S11 and the bottom surface and the side surface of the non-through-hole formed in the step S11, and instead, the through vias 14*i* and the blind via BV may be formed by filling each of the plurality of through-holes and the non-through-hole with the conductor. This case may require the step forming the conductor layers 12 and 13 on the main surface of the substrate 11 separately from the step S12.

Reference Example Group

Figure 8:
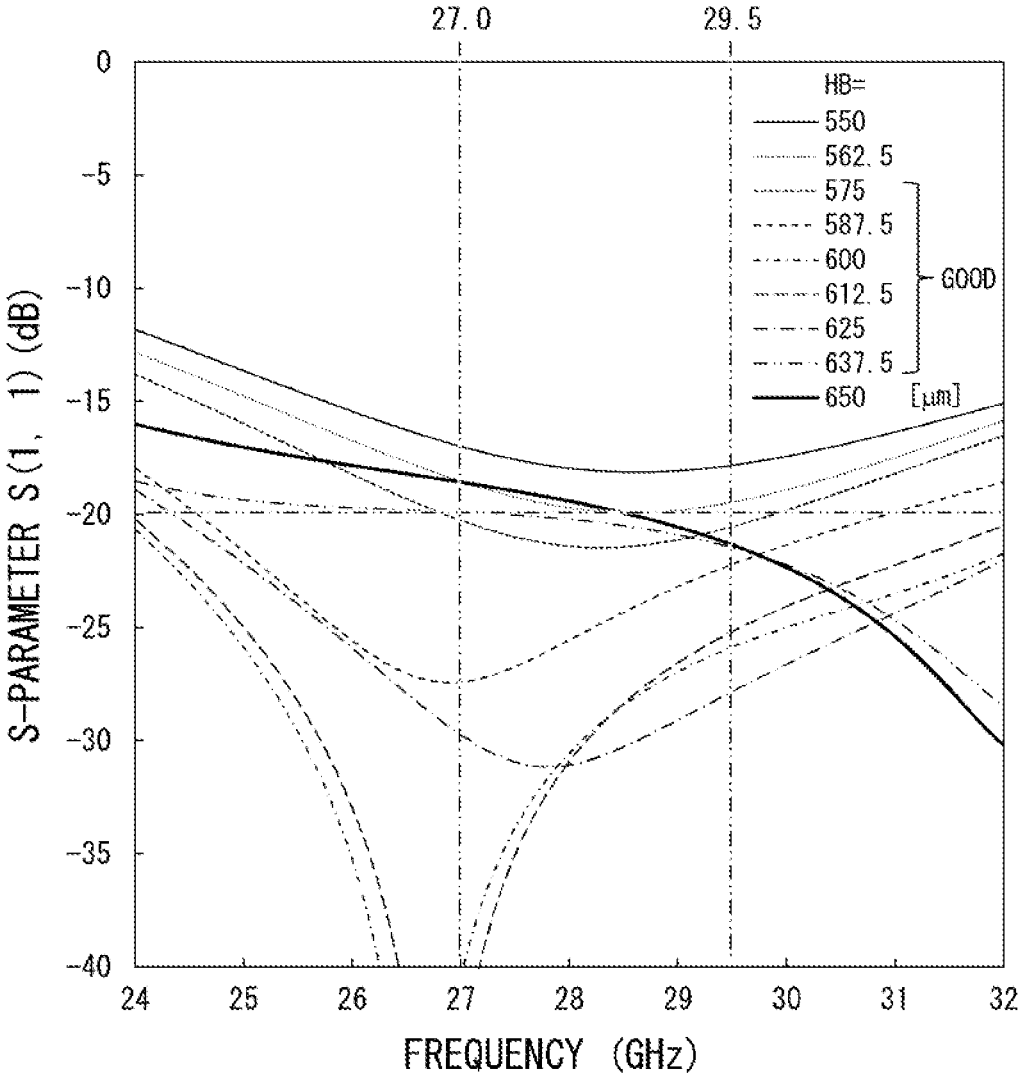
FIG. 8 is a graph showing reflection characteristics of mode converters included in a reference example group of the present invention.

Prior to describing characteristics of groups of examples (a first example group and a second example group, which will be described later) of the mode converter 10 described in Embodiment 1, the following will discuss characteristics of mode converters in a reference example group of the present invention, with reference to FIG. 8. FIG. 8 is a graph showing reflection characteristics of the mode converters included in the reference example group.

The mode converters of the reference example group are obtained by using, as a base, the configuration of the mode converter 10 illustrated in FIG. 1, and changing a blind via shape from the shape of the blind via BV illustrated in (a) of FIG. 2 to a simple cylindrical shape that is circumscribed on the blind via BV. Thus, when seen in plan view, the blind vias of the reference examples each have a circular shape, and the diameter of each of the blind vias is the same as the diameter DB of the blind via BV, that is, 200 μm.

Each of the mode converters of the reference example group were arranged such that: the thickness of a substrate corresponding to the substrate 11 was 700 μm; the width W1 of the post-wall waveguide PW was 4 mm; and the width W2 of the signal line 21 was 200 μm. In addition, in the mode converters of the reference example group, the height HB of each of the cylinders corresponding to the cylinders C1 to C4, by which the shape of the blind via was approximated, was changed in increments of 12.5 μm within a range of not less than 550 μm and not more than 650 μm (see FIG. 8).

Simulations were carried out for wavelength dependence of S-parameter S(1, 1) in dB (hereinafter, referred to as "reflection characteristics") of the mode converters of such a reference example group. FIG. 8 shows results of the simulations. Similarly, simulations were also carried out for wavelength dependence of S-parameter S(2, 1) (hereinafter, referred to as "transmission characteristics") of the mode converters of the reference example group. However, FIG. 8 does not show results of the simulations, since no significant difference can be found in the scale of the vertical axis shown in FIG. 8.

Preferred characteristics of a mode converter can be appropriately set in accordance with an application or the like of the mode converter. In the present reference example group and example groups which will be described below, a preferable mode converter had a band of not less than 27.0 GHz and not more than 29.5 GHz (central frequency is 28.25 GHz) as an operation band, and a reflection characteristic of not more than −20 dB in this operation band.

It was found with reference to FIG. 8 that the mode converters of the reference example group exhibited preferable reflection characteristics in cases where the height HB was not less than 575 μm and not more than 637.5 μm, and exhibited the best reflection characteristic within the operation band in a case where HB=625 μm.

Comparative Example Group

Figure 9:
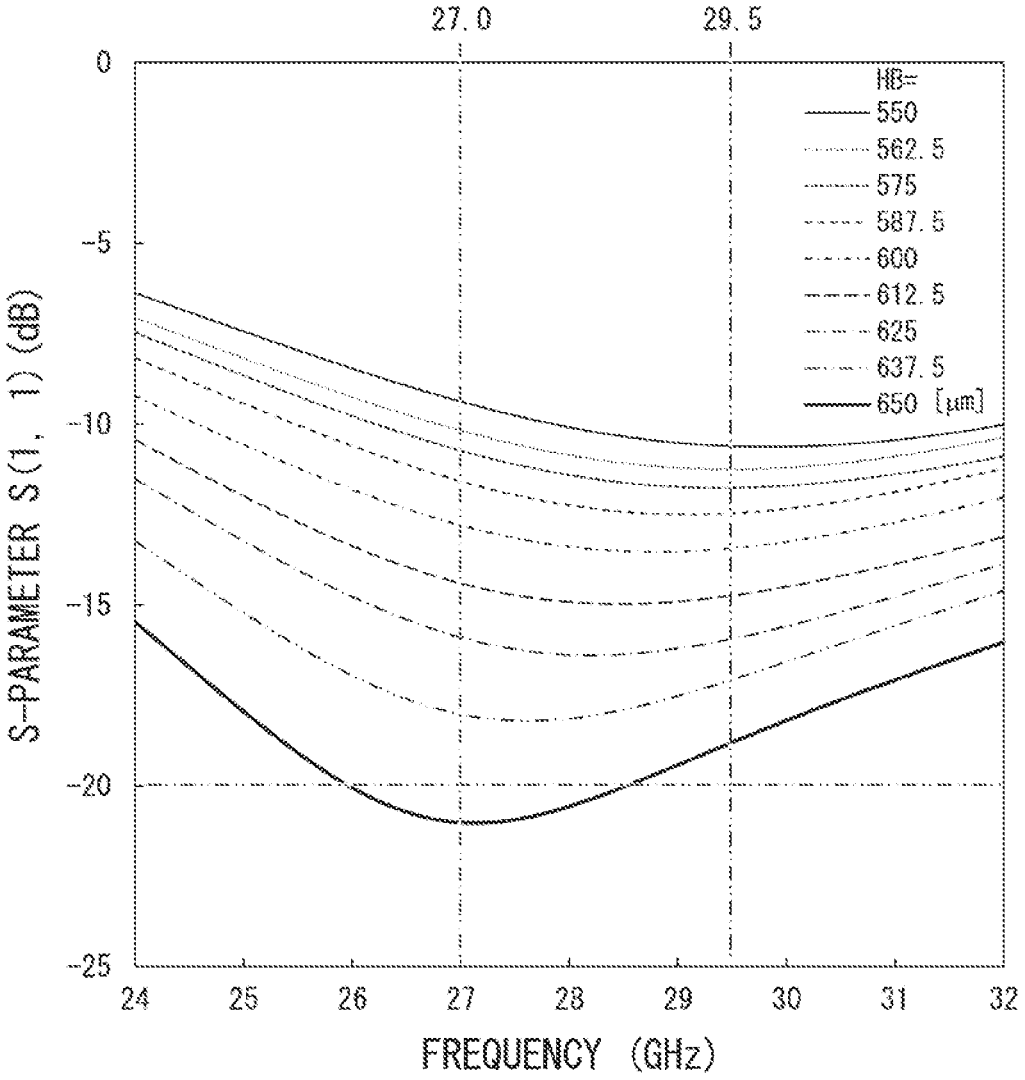
PRIOR ART FIG. 9
FIG. 9 is a graph showing reflection characteristics of mode converters included in a comparative example group (prior art) of the present invention.

The following will discuss characteristics of mode converters included in a comparative example group of the present invention, with reference to FIG. 9. FIG. 9 is a graph showing reflection characteristics of the mode converters included in the comparative example group.

The mode converters of the comparative example group are configured in the same manner as the mode converters of the reference example group except that a diameter DB of 100 μm is employed.

It was found with reference to FIG. 9 that the mode converters of the comparative example group did not exhibit preferable reflective characteristics even when the height HB took any value within the range of not less than 550 μm and not more than 650 μm.

First Example Group

Figure 5:
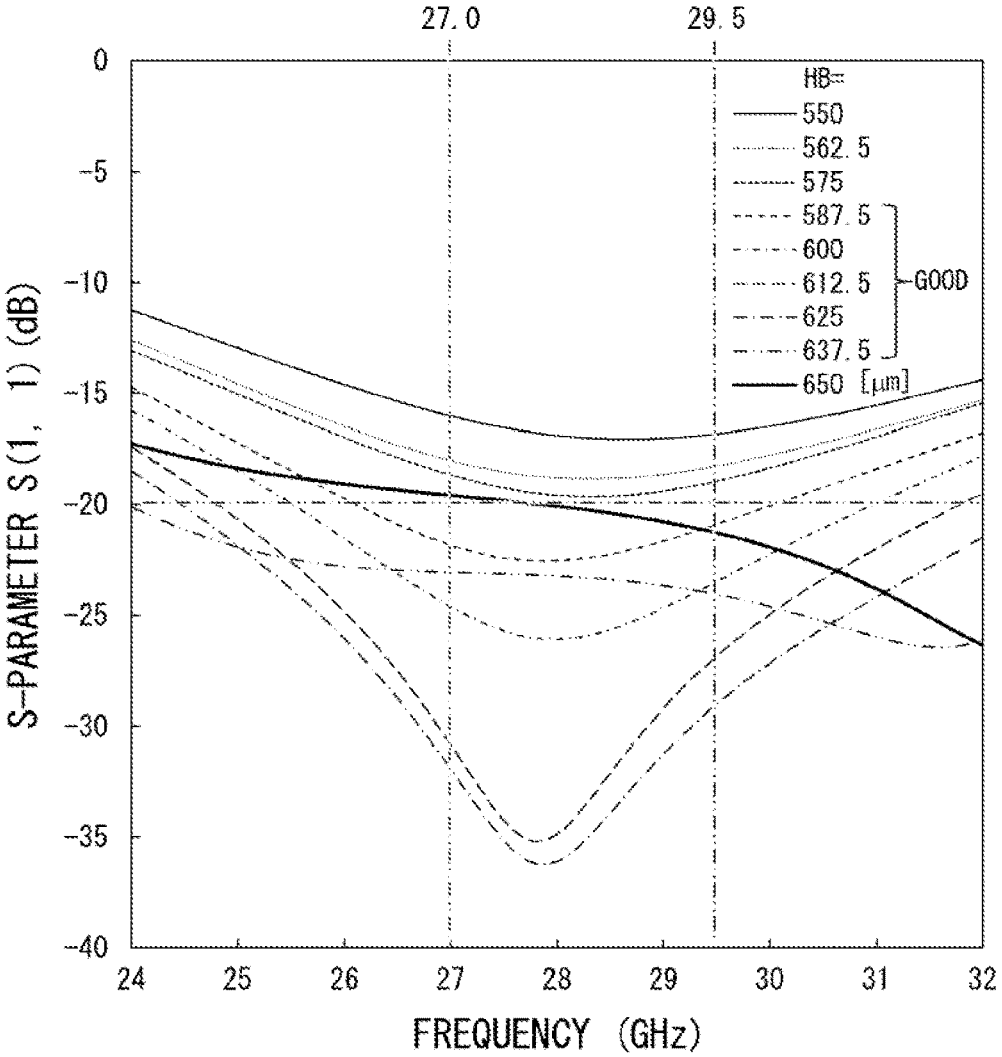
FIG. 5 is a graph showing reflection characteristics of mode converters included in a first example group of the present invention.

A group of examples of the mode converter 10 including the blind via BV illustrated in (a) of FIG. 2 is referred as a "first example group" of the present invention. FIG. 5 is a graph showing reflection characteristics of mode converters 10 of the first example group.

The first example group, like the reference example group, were arranged such that: the thickness of the substrate 11 was 700 μm; the width W1 of the post-wall waveguide PW was 4 mm; and the width W2 of the signal line 21 was 200 μm. In addition, the height HB of each of the cylinders C1 to C4, by which the shape of the blind via BV was approximated, was changed in increments of 12.5 μm within a range of not less than 550 μm and not more than 650 μm (see FIG. 5).

It was found with reference to FIG. 5 that the mode converters 10 of the first example group exhibited preferable reflection characteristics in cases where the height HB was not less than 587.5 μm and not more than 637.5 μm, and exhibited the best reflection characteristic within the operation band in a case where HB=625 μm. It was found that in particular, a mode converter 10 having HB=625 μm exhibited a better reflection characteristic than a mode converter having HB=625 μm among the mode converters of the reference example group.

As described above, it was found that the mode converters 10 of the first example group having the height HB appropriately set exhibited preferable reflection characteristics, as in the cases of the mode converters of the reference example group.

Second Example Group

Figure 6:
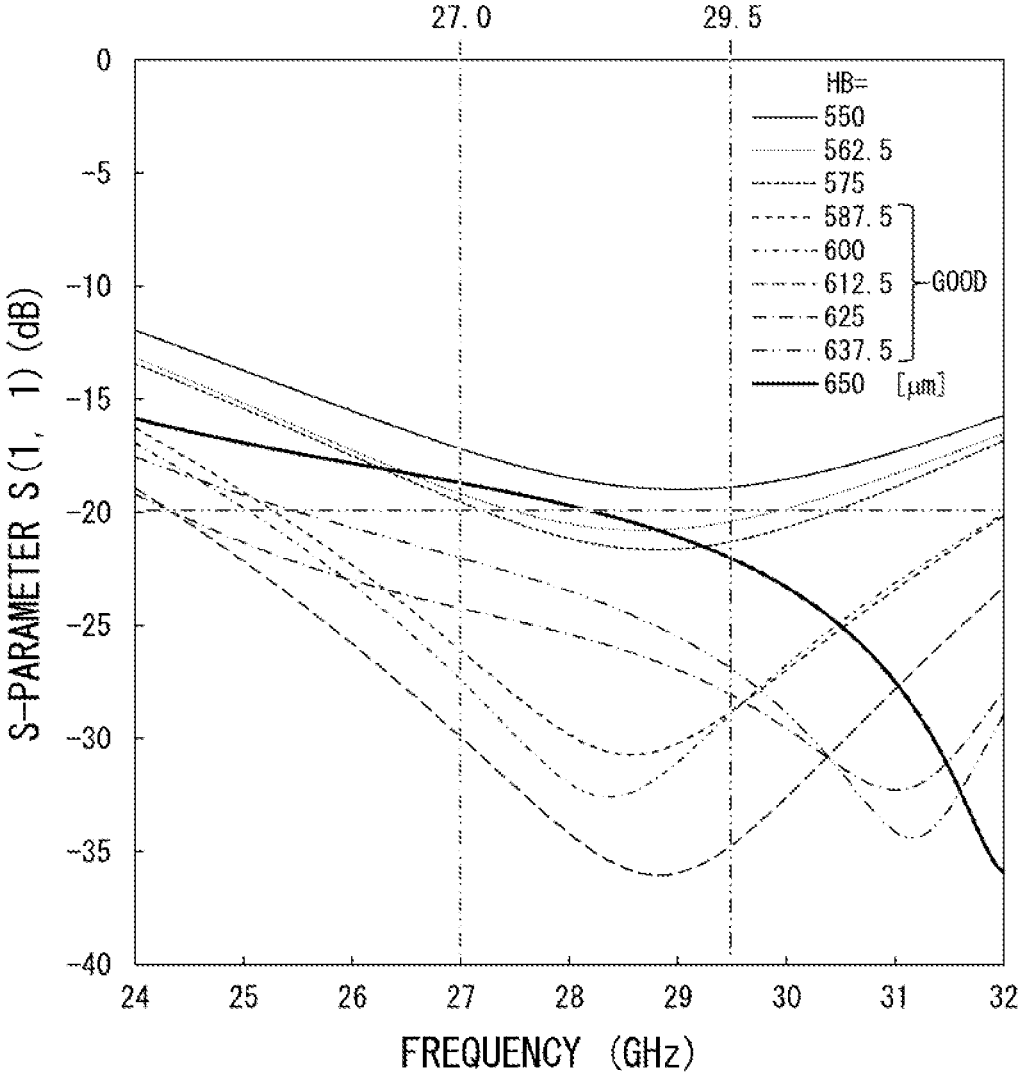
FIG. 6 is a graph showing reflection characteristics of mode converters included in a second example group of the present invention.

A group of examples of a mode converter 10 including the blind via BVA illustrated in (b) of FIG. 2 is referred to as a second example group of the present invention. FIG. 6 is a graph showing reflection characteristics of mode converters 10 of the second example group.

The second example group was arranged to have the same design parameters as the first example group. Therefore, description on the design parameters of the second example group is omitted here.

It was found with reference to FIG. 6 that the mode converters 10 of the second example group exhibited preferable reflection characteristics in cases where the height HB was not less than 587.5 μm and not more than 637.5 μm, and exhibited the best reflection characteristic within the operation band in a case where HB=612.5 μm.

As described above, the mode converters 10 of the second example group having the height HB appropriately set exhibit preferable reflection characteristics as in the case of the mode converters of the reference example group.

Third Example and Fourth Example

Figure 7:
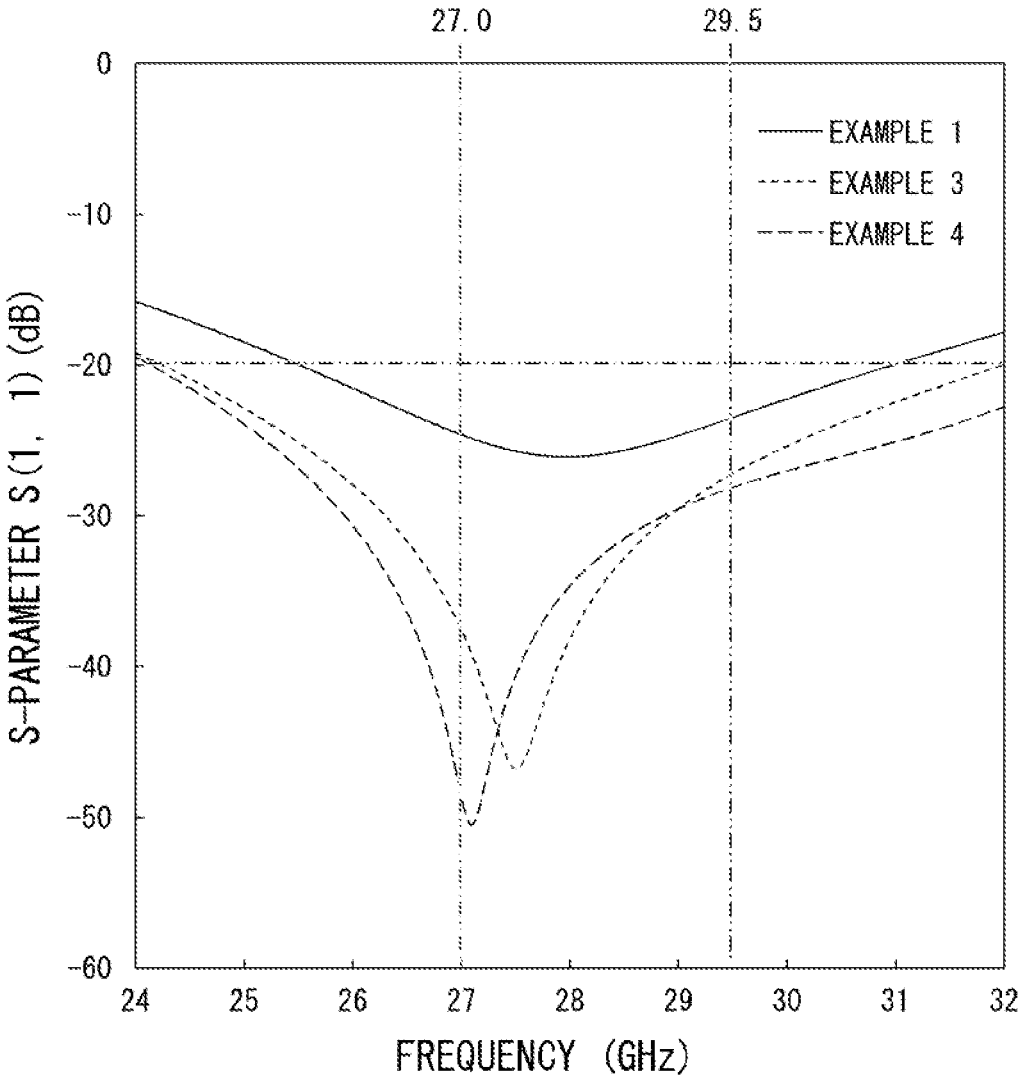
FIG. 7 is a graph showing reflection characteristics of mode converters of a first example, a third example, and a fourth example of the present invention.

A mode converter 10 including the blind via BVB illustrated in (a) of FIG. 3 is referred to as a third example of the present invention. Meanwhile, a mode converter 10 including the blind via BVC illustrated in (b) of FIG. 3 is referred to as a fourth example of the present invention. FIG. 7 is a graph showing respective reflection characteristics of the mode converter 10 of the first example, the mode converter 10 of the third example, and the mode converter 10 of the fourth example.

In the third example and the fourth example, the design parameters except for the height HBb were set to be the same as those of the first example group. Meanwhile, in the third example and the fourth example, the height HBa was set to 600 μm and the height HBb was set to 650 μm. Further, a mode converter 10 having a height HB of 600 μm in the first example group was referred to as a "first example". In other words, the height HB of the first example is the same as the height HBa of each of the third example and the fourth example.

It was found with reference to FIG. 7 that in cases where the height HB and the height HBa were the same, the third example and the fourth example exhibited more preferable reflection characteristics than the first example.

Summary of Examples

As described above, it has become clear that according to an example of the present invention, it is possible to obtain preferable characteristics comparable to the mode converters of the reference example group, even by a mode converter 10 which has, as an operation band, the 28 GHz band, and a width W1 of 4 mm, and which has been obtained by forming the through vias 14*i* and the blind via BV in the substrate 11 in one step.

Aspects of the present invention can also be expressed as follows:

A mode converter in accordance with Aspect 1 of the present invention includes: a post-wall waveguide; a microstrip line formed on a main surface of the post-wall waveguide; and a blind via formed in the post-wall waveguide, the blind via being configured to carry out mutual conversion between a waveguide mode of the post-wall waveguide and a waveguide mode of the microstrip line, the blind via having a shape approximated by a shape obtained by combining a plurality of cylinders having central axes orthogonal to the main surface, respectively, and each of the plurality of cylinders having a diameter equal to a diameter of a cylinder by which a shape of each of through vias constituting a post wall of the post-wall waveguide is approximated.

A method, in accordance with Aspect 5 of the present invention, for manufacturing a mode converter is a method of manufacturing a mode converter which includes: a post-wall waveguide having a narrow wall constituted by a plurality of through vias provided in a palisade arrangement; a microstrip line formed on a main surface of the post-wall waveguide; and a blind via formed in the post-wall waveguide, the blind via being configured to carry out mutual conversion between a waveguide mode of the post-wall waveguide and a waveguide mode of the microstrip line, the method including: a first step of (1) forming a plurality of through-holes each of which has a cylindrical shape, the plurality of through-holes being formed by repeating an operation of forming a through-hole which penetrates through the post-wall waveguide, and (2) forming a non-through-hole which has a shape approximated by a shape obtained by combining a plurality of cylinders having central axes orthogonal to the main surface, respectively, the non-through-hole being formed by repeating an operation of forming a cylindrical non-through hole from a side where the main surface is present toward inside the post-wall waveguide; and a second step of forming the plurality of through vias and the blind via, by covering, with a conductor layer, side surfaces of the plurality of through-holes and a bottom surface and a side surface of the non-through-hole or by filling each of the plurality of through-holes and the non-through-hole with a conductor, in the first step, the plurality of through-holes and a plurality of the cylindrical non-through-holes being formed so as to have diameters equal to each other.

According to the mode converter in accordance with Aspect 1 of the present invention and to the method of manufacturing a mode converter in accordance with Aspect 5 of the present invention, in manufacturing a mode converter having through vias and a blind via which differ in diameter from each other such that the diameter DB of the blind via is larger than the diameter DT of each of the through vias, it is possible to make the diameter of a plurality of non-through-holes, by which the shape of the blind via is approximated, equal to the diameter of the plurality of through-holes corresponding to the plurality of through vias. In other words, in the method of manufacturing a mode converter, it is not necessary to arrange the step of forming the through vias in the substrate and the step of forming the blind via in the substrate as separate steps. Therefore, it is possible to simplify a method of manufacturing a mode converter which carries out mutual conversion between a waveguide mode of a post-wall waveguide and a waveguide mode of a microstrip line.

Further, a mode converter in accordance with Aspect 2 of the present invention is configured as follows in the above-described Aspect 1. That is, the mode converter is configured such that the plurality of cylinders include one cylinder and n cylinders surrounding the one cylinder; and the plurality of cylinders combined have n-fold rotational symmetry with respect to a central axis of the one cylinder as an axis of symmetry.

The above configuration makes the shape of a transverse cross section of the blind via more symmetric and closer to a circle. Therefore, the above configuration can improve a characteristic of the mode converter.

Further, a mode converter in accordance with Aspect 3 of the present invention is configured as follows in the above-described Aspect 2. That is, the mode converter is configured such that the one cylinder has a larger height than the n cylinders.

The above configuration can make the vicinity of the center of the blind via deeper than the vicinity of an outer edge of the blind via. This can improve a characteristic of the mode converter.

Further, a mode converter in accordance with Aspect 4 of the present invention is configured as follows in the above-described Aspect 2 or 3. That is, the mode converter is configured such that a bottom surface of the one cylinder and respective bottom surfaces of the n cylinders are approximated by part of a spherical surface.

The above configuration can make the shape of the bottom surface of the blind via closer to a part of a spherical surface. This can improve a characteristic of the mode converter.

Additional Remarks

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

10 mode converter
PW post-wall waveguide
11 substrate
12, 13 conductor layer
14 post wall
14*a*, 14*b* narrow wall
14*i* through via
15 dielectric layer
MS microstrip line
21 signal line
BV, BVA, BVB, BVC blind via
C1 to C8, C5B, C5C cylinder
A1 to A4, A5B, A5C central axis

The invention claimed is:

1. A mode converter, comprising:

a post-wall waveguide;

a microstrip line formed on a main surface of the post-wall waveguide; and a blind via formed in the post-wall waveguide, the blind via being configured to carry out mutual conversion between a waveguide mode of the post-wall waveguide and a waveguide mode of the microstrip line, the blind via having a shape approximated by a shape characterized by combining respective portions of a plurality of cylinders having central axes orthogonal to the main surface, respectively, and each of the plurality of cylinders having a diameter equal to a diameter of a respective cylinder defining a shape of each of a plurality of through vias constituting a post wall of the post-wall waveguide is approximated.

2. The mode converter as set forth in claim 1, wherein:

the plurality of cylinders include one centrally located cylinder and n cylinders surrounding the one centrally located cylinder; and the plurality of cylinders combined have n-fold rotational symmetry with respect to a central axis of the one centrally located cylinder as an axis of symmetry.

3. The mode converter as set forth in claim 2, wherein the one centrally located cylinder has a larger height than the n cylinders.

4. The mode converter as set forth in claim 2, wherein a bottom surface of the one centrally located cylinder and respective bottom surfaces of the n cylinders are approximated by part of a spherical surface.

5. A method of manufacturing a mode converter, the mode converter including: a post-wall waveguide having a narrow wall constituted by a plurality of through vias, the through vias being arranged so as to surround a planar area; a microstrip line formed on a main surface of the post-wall waveguide; and a blind via formed in the post-wall waveguide, the blind via being configured to carry out mutual conversion between a waveguide mode of the post-wall waveguide and a waveguide mode of the microstrip line, the method comprising:

a first step of (1) forming a plurality of through-holes, each through hole having a cylindrical shape, the plurality of through-holes being formed by repeating an operation of forming a through-hole which penetrates through the post-wall waveguide, and (2) forming a non-through-hole which has a shape approximated by a shape characterized by combining respective portions of a plurality of cylinders having central axes orthogonal to the main surface, respectively, the non-through-hole being formed by repeating an operation of forming an individual cylindrical non-through hole from a side where the main surface is present toward an interior of the post-wall waveguide; and a second step of forming the plurality of through vias and the blind via, by covering, with a conductor layer, side surfaces of the plurality of through-holes and a bottom surface and a side surface of the non-through-hole or by filling each of the plurality of through-holes and the non-through-hole with a conductor, in the first step, the plurality of through-holes and a plurality of the cylindrical non-through-holes being formed so as to have diameters equal to each other.

* * * * *